US006946997B2

(12) United States Patent
Yuanzhu

(10) Patent No.: US 6,946,997 B2
(45) Date of Patent: Sep. 20, 2005

(54) DUAL BAND ANTENNA ALLOWING EASY REDUCTION OF SIZE AND HEIGHT

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 47 days.

(21) Appl. No.: 10/761,631

(22) Filed: Jan. 20, 2004

(65) Prior Publication Data

US 2004/0150567 A1 Aug. 5, 2004

(30) Foreign Application Priority Data

Jan. 23, 2003 (JP) ..... 2003-014989
Jan. 23, 2003 (JP) ..... 2003-015002

(51) Int. Cl.[7] ..... H01Q 1/38; H01Q 9/00
(52) U.S. Cl. ..... 343/700 MS; 343/752
(58) Field of Search ..... 343/700 MS, 752, 343/749, 745

(56) References Cited

U.S. PATENT DOCUMENTS 2,647,211 A 7/1953 Smeby
6,008,773 A * 12/1999 Matsuoka et al. ..... 343/818
6,124,831 A * 9/2000 Rutkowski et al. .. 343/700 MS
6,198,442 B1 3/2001 Rutkowski et al.
6,320,545 B1 11/2001 Nagumo et al.
6,404,394 B1 * 6/2002 Hill ..... 343/702
6,476,767 B2 * 11/2002 Aoyama et al. ..... 343/700 MS
6,563,469 B2 * 5/2003 Miyata et al. ..... 343/743
6,707,427 B2 * 3/2004 Konishi et al. ..... 343/700 MS
6,809,687 B2 * 10/2004 Yuanzhu ..... 343/700 MS
2003/0001781 A1 1/2003 Konishi

FOREIGN PATENT DOCUMENTS

| | | |
|---|---|---|
| EP | 1 306 924 | 5/2003 |
| JP | 2001-068917 | 3/2001 |
| JP | 2003-124729 | 4/2003 |
| WO | WO 02/060006 | 8/2002 |

* cited by examiner

*Primary Examiner*—Don Wong
*Assistant Examiner*—Hung Tran Vy
(74) *Attorney, Agent, or Firm*—Brinks Hofer Gilson & Lione

(57) ABSTRACT

A radiating conductor having first and second meandering portions and capacitive conductor portions is provided on a surface of a dielectric substrate perpendicularly provided on a grounding conductor plate. The first meandering portion and one of the capacitive conductor portions are locally opposed to each other to form a capacitive coupling portion. The first meandering portion receives high-frequency power through its bottom end. The second meandering portion is formed to have a smaller pitch than the first meandering portion, and continues to the upper end of the first meandering portion. One capacitive conductor portion formed on a front surface continues to the upper end of the second meandering portion, while the other capacitive conductor portion is formed on a back surface and connected with the former capacitive conductor portion via through holes.

20 Claims, 4 Drawing Sheets

DUAL BAND ANTENNA ALLOWING EASY REDUCTION OF SIZE AND HEIGHT

BACKGROUND OF THE INVENTION

1. Field of the Invention

The present invention relates to a compact dual band antenna that is capable of transmitting and receiving signal waves of two different frequency bands, and is ideally built in an in-car communication device or the like.

2. Description of the Related Art

FIG. 6 shows a conventionally known antenna device as one of the abovementioned type of dual band antennas. In this antenna device, a radiating conductor formed by connecting two types of meander lines having different pitches is provided on a surface of a substrate (refer to, for example, pages 3 to 4 and FIG. 1 in Japanese Unexamined Patent Application Publication No. 2001-68917).

In a dual band antenna 1 shown in FIG. 6, a radiating conductor 4 formed of copper foil or the like is patterned on a surface of a dielectric substrate 3 vertically provided on a grounding conductor plate 2. The radiating conductor 4 combines a first radiating conductor portion 4*a* formed to extend in a meander-shape at a relatively wide pitch from a vicinity of a feeding point and a second radiating conductor portion 4*b* formed to extend in a meander-shape at a relatively narrow pitch from a distal end of the first radiating conductor portion 4*a*.

In the dual band antenna 1 constructed as described above, the entire radiating conductor 4 from the first radiating conductor portion 4*a* to the second radiating conductor portion 4*b* resonates at a first frequency $f_1$ by supplying first high-frequency power to a feeding point of the radiating conductor 4 through a feeder line, such as a coaxial cable. In addition, only the first radiating conductor portion 4*a* resonates at a second frequency $f_2$, which is higher than the first frequency $f_1$, by supplying second high-frequency power to the feeding point. In other words, it is hard for a high frequency current of a higher frequency to pass through the meander line with a narrow pitch, namely, the second radiating conductor portion 4*b*, thus making it possible to actuate only the first radiating conductor portion 4*a* as a radiating element in response to the second frequency $f_2$. The radiating conductor 4 formed in the meander shape allows the height of the dual band antenna 1 to be considerably reduced at the same electrical length, as compared with a radiating conductor that merely extends in a linear fashion. Thus, the meander shape arrangement is advantageous in making an entire dual band antenna smaller and shorter.

In the conventional dual band antenna 1 shown in FIG. 6, if the meandering pitch or the spacing of the meandering portions of the radiating conductor 4 is excessively narrow, then high-order modes are generated when supplying power to the radiating conductor 4. To avoid this problem, the radiating conductor 4 is formed in a narrower strip to facilitate a reduction in height. Making the radiating conductor 4 narrower, however, results in a narrower resonance frequency band. Therefore, to restrain degradation of the antenna performance, the radiating conductor 4 is designed such that the strip width is large enough while the meander pitch not excessively narrow. Thus, if the two different types of radiating conductor portions 4*a* and 4*b* having different meander pitches are connected in series, as in the case of the conventional dual band antenna 1, then the radiating conductor 4 is naturally lengthy, making it difficult to reduce the height of the entire antenna.

SUMMARY OF THE INVENTION

The present invention has been made with a view toward solving the problem with the prior art, and provides a dual band antenna that can be easily made smaller and shorter.

To this end, one aspect of the present invention provides a dual band-antenna having a grounding conductor. A dielectric substrate is attached to the grounding conductor and has first and second surfaces that are perpendicular to the grounding conductor. A radiating conductor containing a conductive pattern is provided on the first surface of the dielectric substrate. The radiating conductor contains first and second meandering portions and a capacitive conductor portion connected with the second meandering portion. The first meandering portion is formed in a first meander shape and is supplied with high-frequency power. The second meandering portion is formed in a second meander shape connected with an end of the first meandering portion and has a smaller pitch than that of the first meandering shape. The first meandering portion and the capacitive conductor portion are locally opposed to form a capacitive coupling portion.

In the dual band antenna constructed as described above, if the frequency of supplied high-frequency power is relatively low, then current passes from the first meandering portion to the second meandering portion and the capacitive coupling portion whose capacitive reactance increases in this case can be substantially electrically shut-off in relation to the first meandering portion. This makes it possible for the entire first and second meandering portions to resonate at a longer resonance wavelength. However, as the frequency increases, the inductive reactance of the second meandering portion increases, while the capacitive reactance of the capacitive coupling portion decreases. Thus, when the frequency of supplied high-frequency power is high, it is possible to electrically connect the first meandering portion with the capacitive conductor portion through the capacitive coupling portion so that current hardly flows to the second meandering portion. This allows only the first meandering portion to resonate at a small resonance length. In resonance at either high or low frequencies, the capacitive conductor portion functions as a loading capacitor, so that the electrical length of the radiating conductor that resonates at a predetermined frequency is decreased, permitting the height of the entire antenna to be significantly reduced.

In the aforementioned construction, by providing the capacitive conductor portion on opposing surfaces of the inductive substrate and connecting the capacitive conductor portions on these surfaces via through holes, an ample area can be secured on the capacitive conductor portions without increasing the size of the entire antenna. This facilitates a reduction in the size and height of the antenna.

The first and second meandering portions may extend substantially in perpendicular directions. The capacitive conductor may include a main body and an extending portion that extends from the main body, in which case the second meandering portion includes a meanderline section connected with the first meandering portion and a straight line section connected with the extending portion. Likewise, the extending portion may oppose the first meandering portion to form the capacitive coupling portion and/or the first and second meandering portions extend substantially in perpendicular directions with a length of the second meandering portion being substantially equal to a height of the first meandering portion.

Another aspect of the present invention provides a dual band antenna that has a grounding conductor and a first dielectric substrate attached to the grounding conductor. The first dielectric substrate has a first surface that is perpendicular to the grounding conductor and a second surface that is parallel with the first surface. A first radiating conductor includes a meander conductive pattern provided on the first surface of the first dielectric substrate. A second radiating conductor is provided on the first surface of the first dielectric substrate in a branched conductive pattern that is branched from the first radiating conductor. The second radiating conductor has a discontinuous capacitive coupling portion. A first capacitive conductor is disposed such that the first capacitive conductor is substantially parallel to the grounding conductor. The first radiating conductor is connected to the first capacitive conductor.

With this arrangement, inductive reactance of the second radiating conductor having the meander shape increases as the frequency of supplied high-frequency power increases, making it difficult for current to pass therethrough. In contrast, the third radiating conductor makes it more difficult for current to pass therethrough as frequency decreases since the third radiating conductor has the capacitive coupling portion. Hence, the aforementioned dual band antenna makes it possible for the second radiating conductor to resonate when high-frequency power of a relatively low frequency is supplied, and the third radiating conductor to resonate when high-frequency power of a relatively high frequency is supplied. Since the radiating conductors for two types of frequencies, namely, high and low frequencies, are connected in parallel, the height of the dual band antenna can be easily reduced. Moreover, the capacitive conductor functions as a loading capacitor when at least the second radiating conductor resonates, so that the resonance frequency of the radiating conductor decreases. This leads to a shortened electrical length of the radiating conductor required for resonance in response to a predetermined frequency, allowing the height of the entire antenna to be further reduced.

Alternatively, a second dielectric substrate may be attached to the first dielectric substrate such that the second dielectric substrate is substantially parallel to the grounding conductor. A first conductor layer may also be provided on a surface of the second dielectric substrate to serve as the first capacitive conductor.

Alternatively, the second dielectric substrate may be omitted, and a metal conductor plate installed on the dielectric substrate may form the first capacitive conductor. In either case, connecting the upper end of the third radiating conductor as well as- the second radiating conductor to the capacitive conductor allows the electrical length of the third radiating conductor to be reduced.

Alternatively, if the second dielectric substrate is provided, then a second conductor layer forming a second capacitive conductor may be provided on the surface of the second dielectric substrate and be connected with an upper end of the second radiating conductor. Further, the first and second conductive layers may then be electrically isolated from each other on the surface of the second dielectric substrate. In this case, the radiating conductors can be individually connected to capacitive conductors of optimum capacitances.

Preferably, the second radiating conductor is provided on opposing surfaces of the first dielectric substrate, and portions of the second radiating conductor disposed on the first and second surfaces of the first dielectric substrate and that oppose each other with the first dielectric substrate disposed therebetween form the capacitive coupling portion. This arrangement of the dual band antenna makes it possible to easily secure a capacitance required for the capacitive coupling portion by utilizing the dielectric substrate and to easily reduce the height of the third radiating conductor.

The branched conductive pattern of the second radiating conductor may be provided on both the first and second surfaces of the first dielectric substrate. In this case, the branched conductive pattern on the first surface of the first dielectric substrate overlaps the branched conductive pattern on the second surface of the first dielectric substrate.

The first radiating conductor may contain first and second meandering sections of different widths and different pitches. In addition, the antenna may further comprise a power supply configured to supply high-frequency power to a lower end of the first radiating conductor.

The branched conductive pattern of the second radiating conductor may be a straight conductive pattern that extends from a connection between the first and second meandering sections. In this case, the branched conductive pattern of the second radiating conductor may extend in an area adjacent to the second meandering section of the first radiating conductor such that a height of the second meandering section, a width of the branched conductive pattern and a distance between the second meandering section and the branched conductive pattern together are substantially equal to a height of the first meandering section of the first radiating conductor.

In another aspect of the present invention, a method of decreasing a volume of a dual band antenna includes providing (and/or forming) a first dielectric substrate, affixing the first dielectric substrate to a grounding conductor, providing (and/or forming) a first radiating conductor formed of a meander conductive pattern provided on a first surface of the first dielectric substrate, providing (and/or forming) a second radiating conductor formed of a branched conductive pattern that is branched from the first radiating conductor on the first surface of the first dielectric substrate (in which the branched conductive pattern has a discontinuous capacitive coupling portion), connecting a first capacitive conductor to the first dielectric substrate, and connecting the first capacitive conductor and the first radiating conductor. A high-frequency power supply may be connected to a lower end of the first radiating conductor.

A second dielectric substrate may be attached to the first dielectric substrate such that the second dielectric substrate is substantially parallel to the grounding conductor and a first conductive layer provided (and/or formed) on a surface of the second dielectric substrate that serves as the first capacitive conductor. In this case, a second conductive layer may be provided (and/or formed) on the surface of the second dielectric substrate such that the first and second conductive layers are electrically isolated from each other on the surface of the second dielectric substrate (in which the second conductive layer forms a second capacitive conductor), and an upper end of the second radiating conductor connected to the second capacitive conductor.

Alternatively, a metal conductor plate may be affixed to the first dielectric substrate to serve as the first capacitive conductor. The second radiating conductor may be provided (and/or formed) on both the first and second surfaces of the first dielectric substrate, and the capacitive coupling portion formed using sections of the second radiating conductor disposed on the first and second surfaces of the first dielectric substrate that oppose each other with the first dielectric substrate disposed therebetween.

The first radiating conductor may be formed to contain first and second meandering sections of different widths and different pitches. In this case, the branched conductive pattern of the second radiating conductor may be formed as a straight conductive pattern that extends from a connection between the first and second meandering sections. The branched conductive pattern of the second radiating conductor may be formed to extend in an area adjacent to the second meandering section of the first radiating conductor such that a height of the second meandering section. A width of the branched conductive pattern and a distance between the second meandering section and the branched conductive pattern together are substantially equal, in this case, to a height of the first meandering section of the first radiating conductor.

DESCRIPTION OF THE PREFERRED EMBODIMENTS

Figure 1:
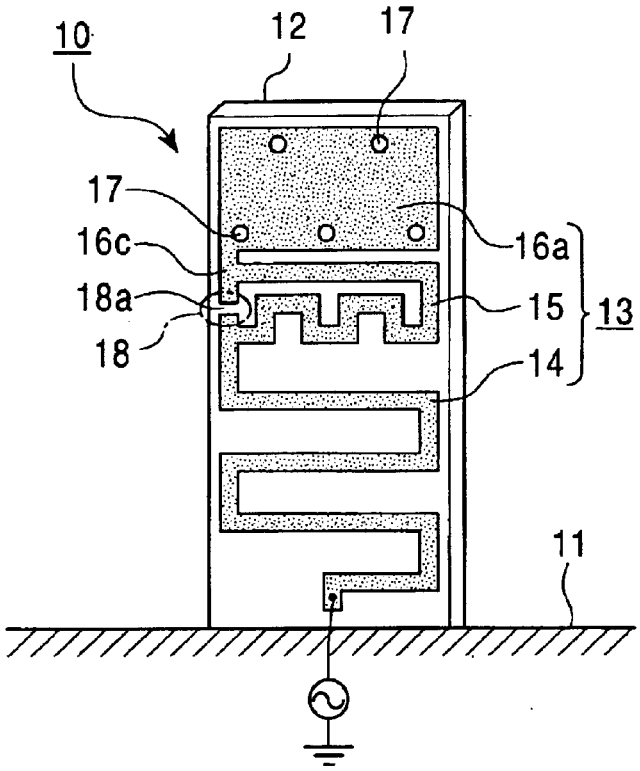
FIG. 1 is a perspective view of a dual band antenna according to a first embodiment of the present invention.

A first embodiment in accordance with the present invention will be explained with reference to the accompanying drawings. FIG. 1 is a front view of a dual band antenna according to the first embodiment of the present invention, FIG. 2 is a rear view of the dual band antenna, and FIG. 3 is an equivalent circuit diagram of the dual band antenna.

Figure 2:
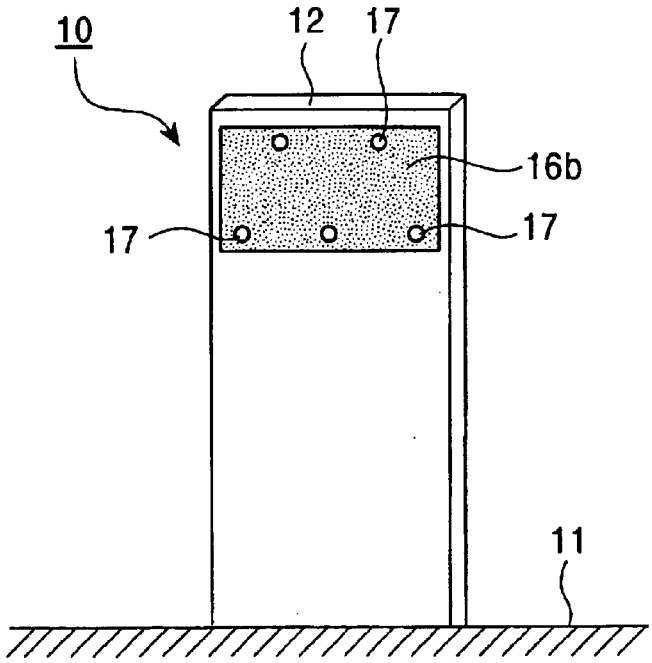
FIG. 2 is a rear view of the dual band antenna.

A dual band antenna 10 shown in FIGS. 1 and 2 is constituted by a first radiating conductor 13 formed by patterning copper foil or the like into a predetermined configuration on both front and back surfaces of a dielectric substrate 12 vertically provided on a grounding conductor plate 11. The first radiating conductor 13 has a first meandering portion 14 formed of a wide strip, a second meandering portion 15 that is formed of a strip slightly narrower than that of the first meandering portion 14 and continues from the upper end of the first meandering portion 14, and capacitive conductor portions 16*a* and 16*b* that are formed in regions on topmost front and back surfaces of the dielectric substrate 12 and connected via through holes 17. An extending portion 16*c* that extends downward from the capacitive conductor portion 16*a* is joined to the upper end of the second meandering portion 15. The upper end of the first meandering portion 14 and the extending portion 16*c* of the capacitive conductor portion 16*a* are opposed to each other with a predetermined gap 18*a* provided therebetween so as to capacitively couple the first meandering portion 14 and the capacitive conductor portion 16*a*. In other words, the portions of the first meandering portion 14 and the capacitive conductor portion 16*a* that oppose each other with the gap 18*a* provided therebetween form a capacitive coupling portion 18.

High-frequency power of a first frequency $f_1$ and high-frequency power having a second frequency $f_2$ that is higher than the first frequency $f_1$ are selectively supplied to the lower end of the first meandering portion 14 through a feeder line, such as a coaxial cable. The first meandering portion 14 has a smaller inductance since it is wider and has a larger meander pitch, while the second meandering portion 15 has a larger inductance since it is narrower and has a smaller pitch than the first meandering portion 14. For this reason, the second meandering portion 15 does not block current if the frequency of supplied high-frequency power is as low as about $f_1$, because the inductive reactance is small. If, however, the frequency increases to about $f_2$, the inductive reactance increases, making it difficult for current to pass through the second meandering portion 15. Meanwhile, the capacitive coupling portion 18 is substantially electrically isolated from the first meandering portion 14 due to a large capacitive reactance if the frequency of supplied high-frequency power is as low as $f_1$. If, however, the frequency increases to about $f_2$, then the capacitive reactance reduces, so that the first meandering portion 14 is electrically connected to the capacitive conductor portion 16*a* through the capacitive coupling portion 18.

Figure 3:
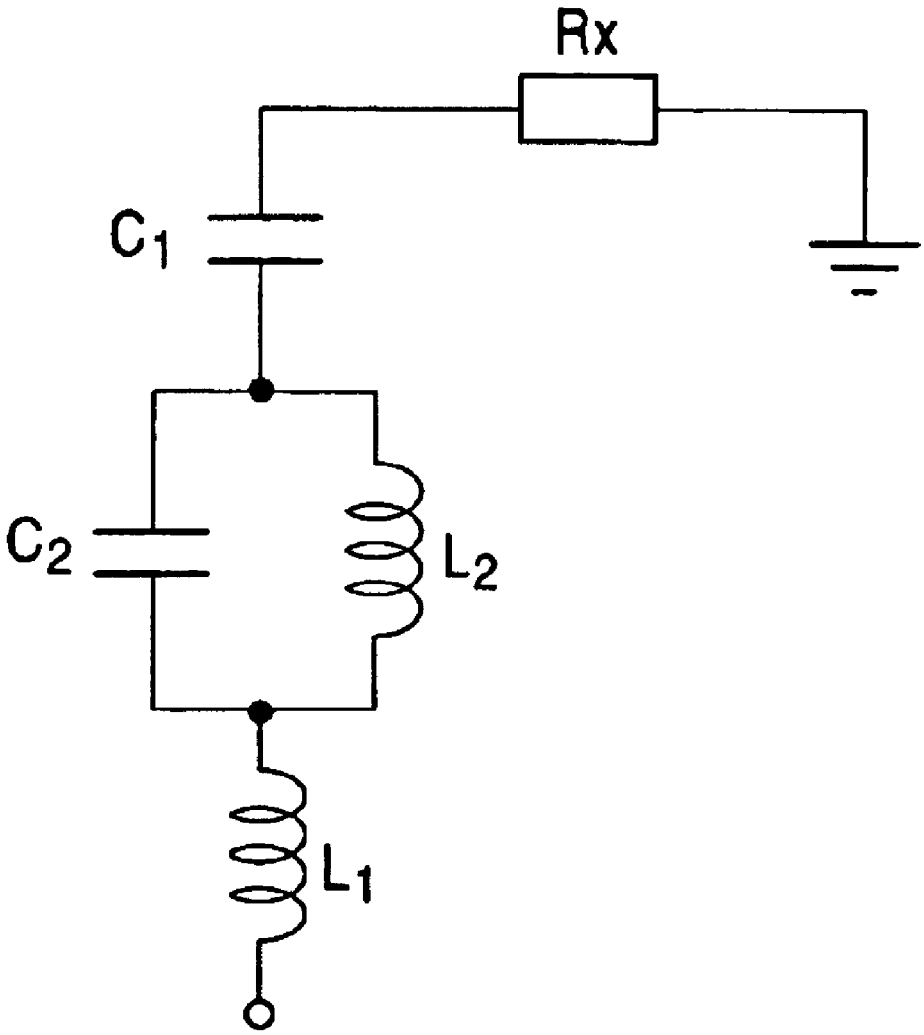
FIG. 3 is an equivalent circuit diagram of the dual band antenna.

Referring to FIG. 3, which shows an equivalent circuit diagram of the dual band antenna 10, an inductor $L_1$ denotes the first meandering portion 14, an inductor $L_2$ denotes a second meandering portion 15, a capacitor $C_1$ denotes the capacitive coupling portion 18, and a capacitor $C_2$ denotes the capacitive conductor portions 16*a* and 16*b*. In the figure, Rx denotes a radiation resistor.

Operation of the dual band antenna 10 will now be explained. When high-frequency power of the first frequency $f_1$ is supplied to the lower end of the first meandering portion 14, current flows from the first meandering portion 14 to the second meandering portion 15, allowing the entire first and second meandering portions 14 and 15 to resonate at a rather large resonance length. At this time, the capacitive coupling portion 18 having a large reactance is virtually electrically isolated from the first meandering portion 14. Furthermore, the capacitive conductor portions 16*a* and 16*b* having large areas function as a loading capacitor, markedly reducing the electrical length required for resonance at the first frequency $f_1$. This allows the total length of the first and second meandering portions 14 and 15 to remain relatively short, contributing to easy reduction of the height of the antenna as a whole. Moreover, both front and back surfaces of the dielectric substrate 12 are utilized to form the capacitive conductor portions 16*a* and 16*b*, so that an ample area can be secured for the capacitive conductor portions 16*a* and 16*b* without increasing the size of the dielectric substrate 12. This adds to ease of making the entire antenna smaller.

When high-frequency power of the second frequency $f_2$ is supplied to the lower end of the first meandering portion 14, the first meandering portion 14 is electrically connected to the capacitive conductor portions 16*a* and 16*b* through the capacitive coupling portion 18, and current hardly flows through the second meandering portion 15, thus allowing only the first meandering portion 14 to resonance at a short resonance length. In this case as well, the capacitive conductor portions 16*a* and 16*b* act as a loading capacitor, considerably reducing the electrical length required for resonating to the second frequency $f_2$. Thus, it is possible to easily achieve a smaller, shorter dual band antenna 10 capable of resonating at two (high and low) frequencies.

In the embodiment described above, a part of the first meandering portion 14 and a part of the capacitive conductor portion 16*a* are opposed to each other with the gap 18*a* therebetween to form the capacitive coupling portion 18. Alternatively, however, a part of the first meandering portion 14 may be opposed to the capacitive conductor portion 16*b* on the rear surface through the intermediary of the inductive substrate 12 so as to form the capacitive coupling portion.

In the embodiment described above, the capacitive conductor portions 16*a* and 16*b* are formed on both front and rear surfaces of the dielectric substrate 12 to obtain a larger capacitance value. Alternatively, however, the capacitive conductor portion may be provided on only one surface of the dielectric substrate 12, or a metal conductor plate or the like installed perpendicular to the surface of the dielectric substrate 12 may be connected to the capacitive conductor portion to considerably increase a capacitance value.

Figure 4:
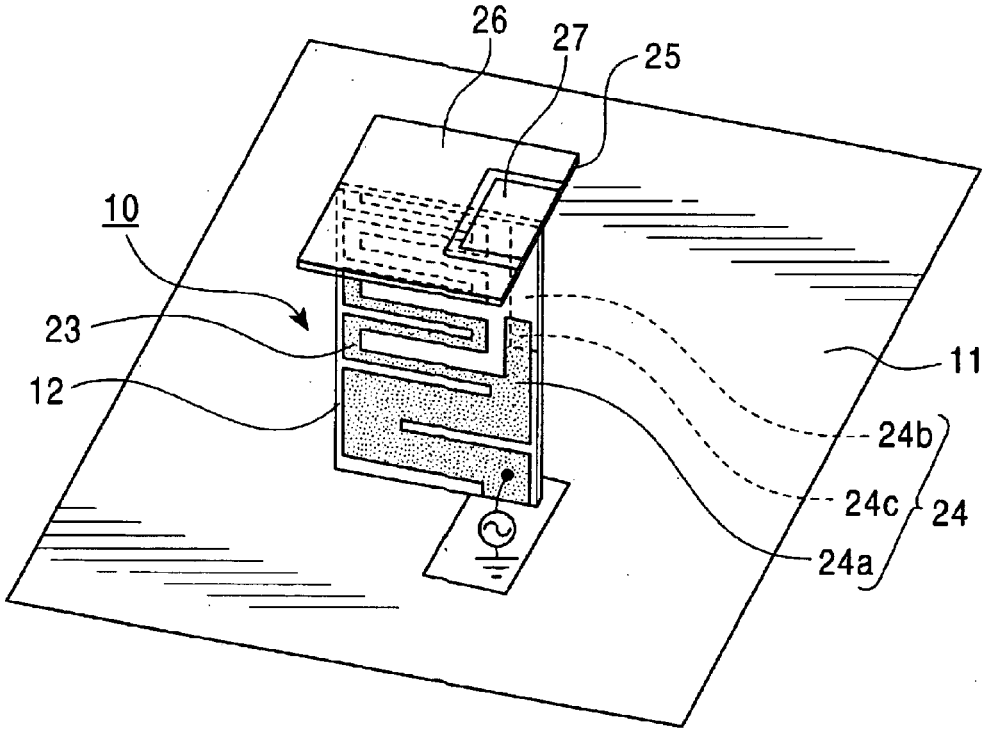
FIG. 4 is a perspective view of a dual band antenna according to a second embodiment of the present invention.
Figure 5:
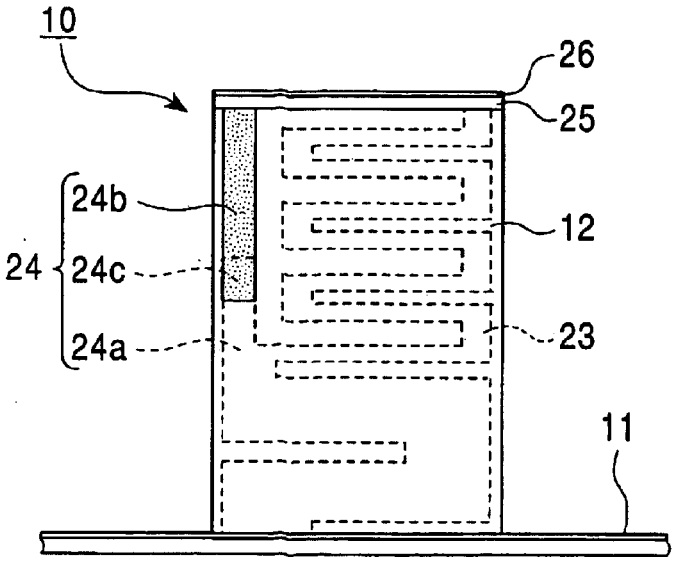
FIG. 5 is a rear view of the dual band antenna.
Figure 6:
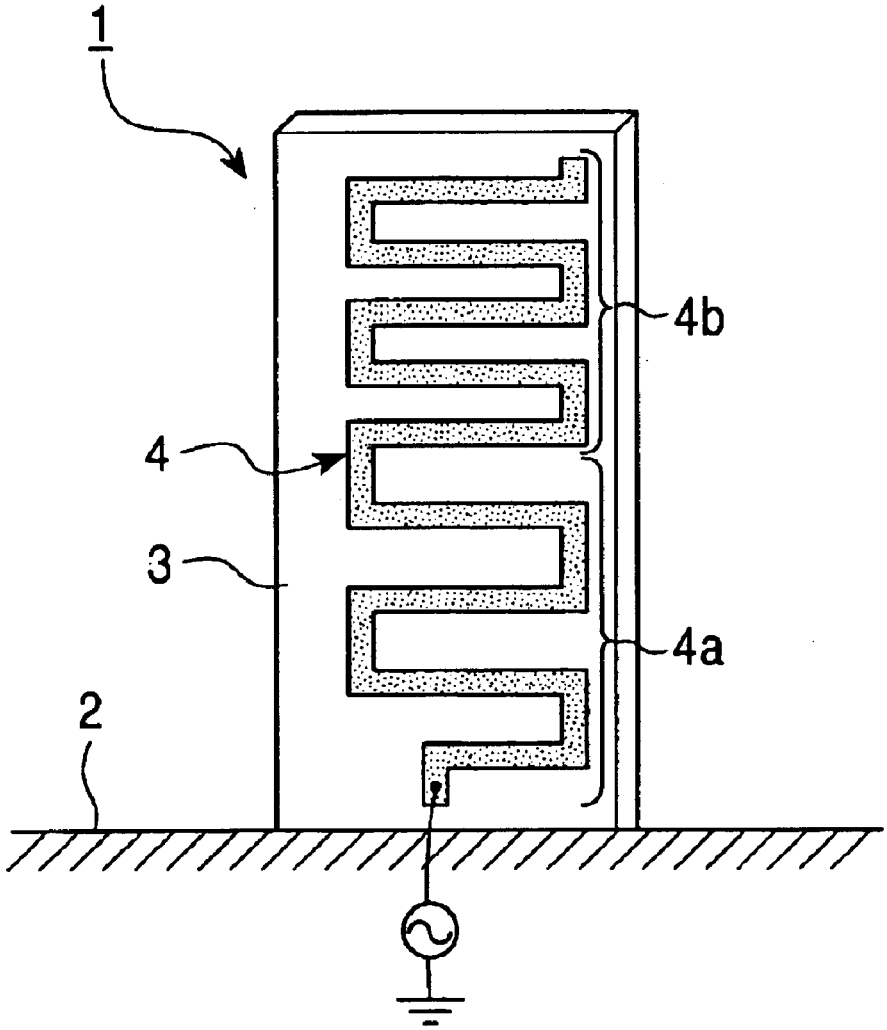
FIG. 6 PRIOR ART
FIG. 6 is a schematic representation showing a conventional example.

A second embodiment in accordance with the present invention will now be described with reference to the accompanying drawings. FIG. 4 is a perspective view of a dual band antenna according to the second embodiment of the present invention. FIG. 5 is a rear view of the dual band antenna.

A dual band antenna 10 shown in the figures has a second radiating conductor 23 and a third radiating conductor 24 formed by patterning a copper foil or the like on both front and rear surfaces of the dielectric substrate 12 vertically provided on a grounding conductor plate 11. A small dielectric substrate 25 is fixedly mounted on the dielectric substrate 12 such that it is disposed in parallel to the grounding conductor plate 11. A first capacitive conductor 26 and a second capacitive conductor 27 formed of a conductor layer of copper foil or the like are provided on the small dielectric substrate 25 and separated from each other. The second radiating conductor 23 provided on the front surface of the dielectric substrate 12 is formed in a meander shape. A feeder line (not shown) composed of a coaxial cable or the like is connected to the lower end of the second radiating conductor 23, and high-frequency power of two frequencies (high and low) are supplied through the feeder line. The upper end of the second radiating conductor 23 is connected to the first capacitive conductor 26.

The third radiating conductor 24 is constructed of a strip-shaped lower pattern portion 24*a*, which is provided on the front surface of the dielectric substrate 12 and branched upward from the second radiating conductor 23, and a strip-shaped upper pattern portion 24*b*, which is provided on the rear surface of the dielectric substrate 12 and partly overlaps the strip-shaped lower pattern portion 24*a*. The upper end of the strip-shaped upper pattern portion 24*b* is connected to the second capacitive conductor 27. The portion where the strip-shaped lower pattern portion 24*a* and the strip-shaped upper pattern portion 24*b* overlap each other through the intermediary of the dielectric substrate 12 provides a capacitive coupling portion 24*c* of the third radiating conductor 24.

In the dual band antenna 10 constructed as described above, when high-frequency power of a first frequency $f_1$ is supplied through the feeder line, the second radiating conductor 23 resonates. When a second frequency $f_2$, which is higher than the first frequency $f_1$, is supplied, the third radiating conductor 24 resonates. More specifically, the inductive reactance of the second radiating conductor 23 having a meander shape increases as the frequency of the supplied high-frequency power increases, making it harder for current to pass therethrough. In contrast, it becomes more difficult for current to pass through the third radiating conductor 24 as the frequency of the supplied high-frequency power decreases because of the presence of the capacitive coupling portion 24*c*.

With this arrangement, it is possible for the meander-shaped second radiating conductor 23 to resonate when high-frequency power of the relatively low frequency $f_1$ is supplied, and for the third radiating conductor 24 to resonate when high-frequency power of the relatively high frequency $f_2$ is supplied, as described above.

Since the second radiating conductor 23 and the third radiating conductor 24 for the two frequencies (high and low frequencies) are connected in parallel, it is easy to reduce the height of the dual band antenna 10. In addition, the first capacitive conductor 26 functions as a loading capacitor for reducing resonance frequencies when the second radiating conductor 23 resonates, while the second capacitive conductor 27 functions as a loading capacitor for reducing resonance frequencies when the third radiating conductor 24 resonates, so that the electrical lengths of both radiating conductors 23 and 24 are shortened. This also contributes to the ease of reducing the height of the antenna. Thus, the dual band antenna 10 can be made smaller and shorter with ease.

According to the present embodiment, in the third radiating conductor 24, the capacitive coupling portion 24*c* is formed by the discontinuous portion where the strip-shaped lower pattern portion 24*a* and the strip-shaped upper pattern portion 24*b* provided on both front and back surfaces of the dielectric substrate 12 overlap each other. This arrangement makes it possible to easily secure a capacitance required for the capacitive coupling portion 24*c* by utilizing the dielectric substrate 12 and to easily reduce the height of the third radiating conductor 24. Alternatively, however, the strip-shaped lower pattern portion and the strip-shaped upper pattern portion may be provided apart from each other at top and bottom on one surface of the dielectric substrate 12, and the discontinuous portion thereof may provide the capacitive coupling portion.

According to the present embodiment, the small dielectric substrate 25 is provided with the first capacitive conductor 26 and the second capacitive conductor 27, and these capacitive conductors 26 and 27 are connected to the upper ends of the radiating conductors 23 and 24, respectively. With this arrangement, the radiating conductors 23 and 24 can be individually connected to capacitive conductors of optimum capacitances. Alternatively, however, both radiating conductors 23 and 24 may be connected to the same capacitive conductor. In this case, the small dielectric substrate 25 may be omitted, and the metal conductor plate installed on the dielectric substrate 12 may be used as a capacitive conductor.

It is intended that the foregoing detailed description be regarded as illustrative rather than limiting, and that it be understood that it is the following claims, including all equivalents, that are intended to define the spirit and scope of this invention.

What is claimed is:

1. A dual band antenna comprising:

a grounding conductor;

a first dielectric substrate attached to the grounding conductor, the first dielectric substrate having a first surface that is perpendicular to the grounding conductor and a second surface that is parallel with the first surface;

a first radiating conductor containing a meander conductive pattern provided on the first surface of the first dielectric substrate;

a second radiating conductor provided on the first surface of the first dielectric substrate in a branched conductive pattern that is branched from the first radiating conductor and has a discontinuous capacitive coupling portion; and a first capacitive conductor disposed on plane such that the first capacitive conductor is substantially parallel to the grounding conductor and to which at least the first radiating conductor is connected.

2. The dual band antenna according to claim 1, further comprising:

a second dielectric substrate attached to the first dielectric substrate such that the second dielectric substrate is substantially parallel to the grounding conductor; and a first conductive layer provided on a surface of the second dielectric substrate that serves as the first capacitive conductor.

3. The dual band antenna according to claim 2, wherein:

a second conductive layer forming a second capacitive conductor is provided on the surface of the second dielectric substrate, the first and second conductive layers are electrically isolated from each other on the surface of the second dielectric substrate, and an upper end of the second radiating conductor is connected to the second capacitive conductor.

4. The dual band antenna according to claim 3, wherein the first and second capacitive conductors have different areas.

5. The dual band antenna according to claim 1, wherein a metal conductor plate installed on the first dielectric substrate serves as the first capacitive conductor.

6. The dual band antenna according to claim 1, wherein:

the second radiating conductor is provided on both the first and second surfaces of the first dielectric substrate, and portions of the second radiating conductor disposed on the first and second surfaces of the first dielectric substrate and that oppose each other with the first dielectric substrate disposed therebetween form the capacitive coupling portion.

7. The dual band antenna according to claim 1, wherein the branched conductive pattern of the second radiating conductor is provided on both the first and second surfaces of the first dielectric substrate, and the branched conductive pattern on the first surface of the first dielectric substrate overlaps the branched conductive pattern on the second surface of the first dielectric substrate.

8. The dual band antenna according to claim 1, wherein the first radiating conductor contains first and second meandering sections of different widths and different pitches.

9. The dual band antenna according to claim 8, wherein the branched conductive pattern of the second radiating conductor is a straight conductive pattern that extends from a connection between the first and second meandering sections.

10. The dual band antenna according to claim 9, wherein the branched conductive pattern of the second radiating conductor extends in an area adjacent to the second meandering section of the first radiating conductor such that a height of the second meandering section, a width of the branched conductive pattern and a distance between the second meandering section and the branched conductive pattern together are substantially equal to a height of the first meandering section of the first radiating conductor.

11. The dual band antenna according to claim 1, further comprising a power supply configured to supply high-frequency power to a lower end of the first radiating conductor.

12. A method of decreasing a volume of a dual band antenna, the method comprising:

providing a first dielectric substrate; affixing the first dielectric substrate to a grounding conductor; providing a first radiating conductor formed of a meander conductive pattern provided on a first surface of the first dielectric substrate;

providing a second radiating conductor formed of a branched conductive pattern that is branched from the first radiating conductor on the first surface of the first dielectric substrate, the branched conductive pattern having a discontinuous capacitive coupling portion; and connecting a first capacitive conductor to the first dielectric substrate such that the first capacitive conductor is disposed on a plane substantially parallel to the grounding conductor; and connecting the first capacitive conductor and the first radiating conductor.

13. The method according to claim 12, further comprising:

attaching a second dielectric substrate to the first dielectric substrate such that the second dielectric substrate is substantially parallel to the grounding conductor; and providing a first conductive layer on a surface of the second dielectric substrate that serves as the first capacitive conductor.

14. The method according to claim 13, further comprising:

providing a second conductive layer on the surface of the second dielectric substrate such that the first and second conductive layers are electrically isolated from each other on the surface of the second dielectric substrate, the second conductive layer forming a second capacitive conductor, and connecting an upper end of the second radiating conductor to the second capacitive conductor.

15. The method according to claim 12, further comprising affixing a metal conductor plate to the first dielectric substrate to serve as the first capacitive conductor.

16. The method according to claim 12, further comprising:

providing the second radiating conductor on both the first and second surfaces of the first dielectric substrate, and forming the capacitive coupling portion using sections of the second radiating conductor disposed on the first and second surfaces of the first dielectric substrate that oppose each other with the first dielectric substrate disposed therebetween.

17. The method according to claim 12, further comprising forming the first radiating conductor to contain first and second meandering sections of different widths and different pitches.

18. The method according to claim 17, further comprising forming the branched conductive pattern of the second radiating conductor as a straight conductive pattern that extends from a connection between the first and second meandering sections.

19. The method according to claim 18, further comprising forming the branched conductive pattern of the second radiating conductor to extend in an area adjacent to the second meandering section of the first radiating conductor such that a height of the second meandering section, a width of the branched conductive pattern and a distance between the second meandering section and the branched conductive pattern together are substantially equal to a height of the first meandering section of the first radiating conductor.

20. The method according to claim 12, further comprising connecting a high-frequency power supply to a lower end of the first radiating conductor.

* * * * *